US005511601A

United States Patent [19]

Worthington

[11] Patent Number: 5,511,601

[45] Date of Patent: Apr. 30, 1996

[54] DRIVE MECHANISM FOR VENETIAN BLINDS

[76] Inventor: Herbert Worthington, 38 Noe Ave., Madison, N.J. 07940

[21] Appl. No.: 307,158

[22] Filed: Sep. 16, 1994

[51] Int. Cl.[6] ..... E06B 9/26

[52] U.S. Cl. ..... 160/176.1; 160/7

[58] Field of Search ..... 160/168.1 P, 176.1 P, 160/DIG. 17, 1, 7, 2, 188, 331, 310

[56] References Cited

U.S. PATENT DOCUMENTS

| | | | |
|---|---|---|---|
| 1,187,381 | 6/1916 | Palmer . | |
| 1,525,781 | 2/1925 | Sheppard . | |
| 3,680,622 | 8/1972 | Lester | 160/310 X |
| 3,955,661 | 5/1976 | Popper et al. | 160/188 X |
| 4,173,721 | 11/1979 | Louis | 307/115 |
| 4,503,900 | 3/1985 | Osaka et al. | 160/176.1 P X |
| 4,610,294 | 9/1986 | Anesi et al. | 160/331 |
| 4,644,990 | 2/1987 | Webb et al. | 160/176.1 P X |
| 4,664,169 | 5/1987 | Osaka et al. | 160/107 |
| 4,958,112 | 9/1990 | Zerillo | 318/280 |
| 5,175,478 | 12/1992 | Chen | 160/DIG. 7 X |
| 5,391,967 | 2/1995 | Domel et al. | 160/DIG. 7 X |

*Primary Examiner*—David M. Purol
*Attorney, Agent, or Firm*—Thomas L. Adams

[57] ABSTRACT

A drive mechanism can spin a vertical adjustment rod of a venetian blind mounted at a window. The mechanism has a case adapted to be mounted at the window. A power driver is mounted in the case and is adapted to be coupled to the adjustment rod. This driver can turn the adjustment rod. A controller is coupled to the driver for controlling the turning of the adjustment rod.

22 Claims, 2 Drawing Sheets

FIG. 1
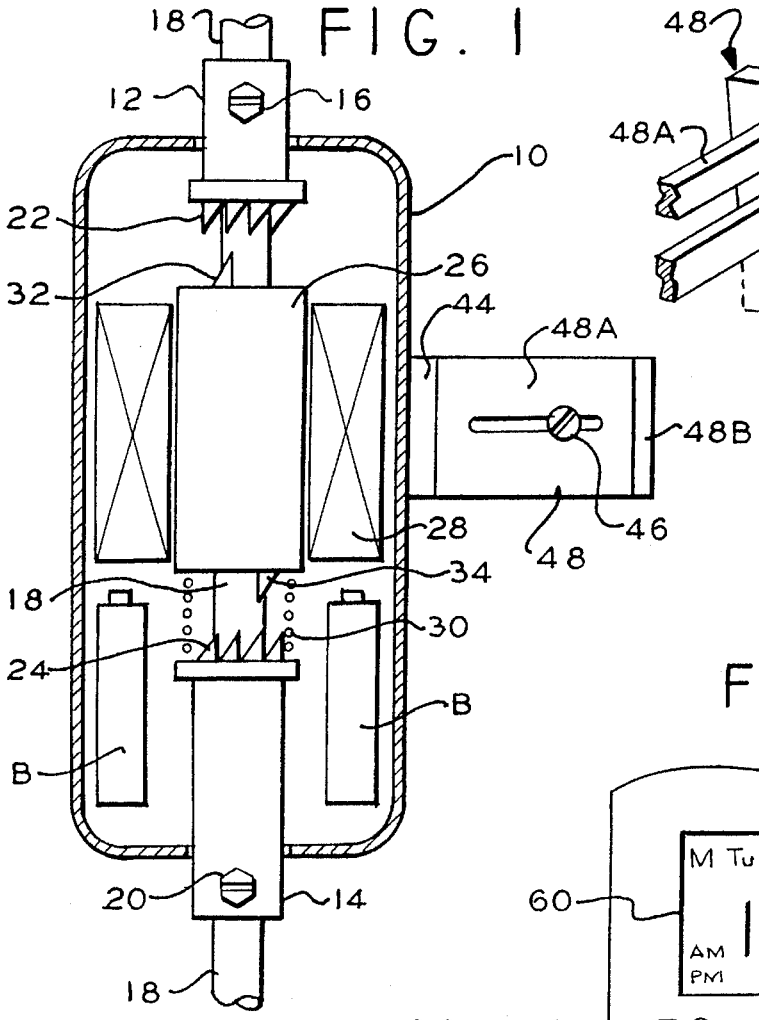
FIG. 3
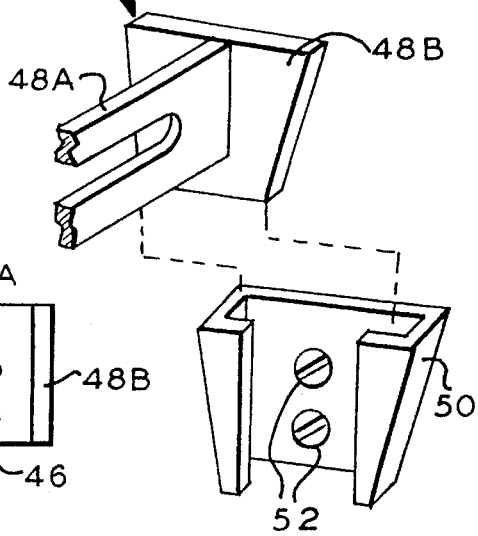
FIG. 5
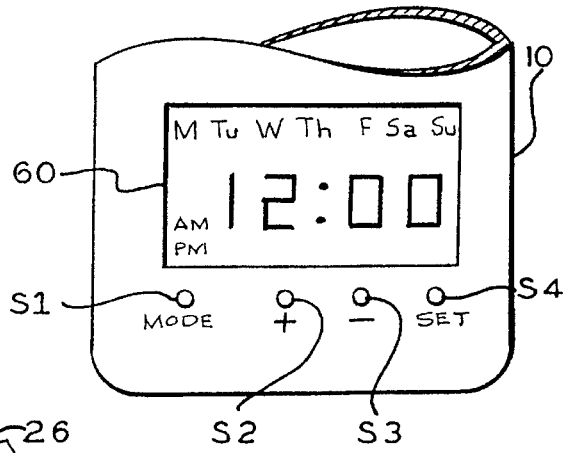
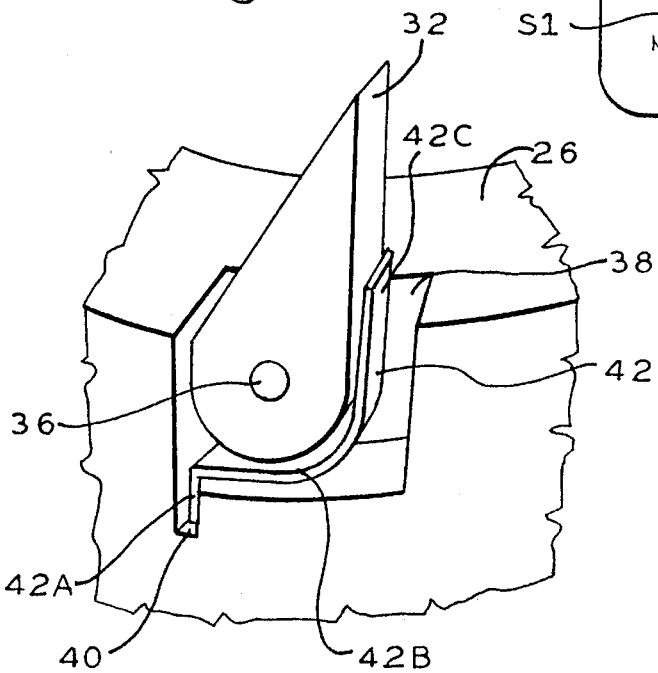
FIG. 2

DRIVE MECHANISM FOR VENETIAN BLINDS

BACKGROUND OF THE INVENTION

1. Field of the Invention

The present invention relates to power mechanisms for adjusting venetian blinds, and in particular, to mechanisms having controllers for controlling the blind adjustment.

2. Description of Related Art

The well known venetian blinds are used to adjust the amount of sunlight entering a room. These blinds are often adjusted according to a predetermined schedule. For example, one may wish to close the blinds during a part of the day when the sun produces unacceptable glare. Also, house plants placed near a window may have special sunlight requirements. For example, some plants can be hurt by strong direct sunlight. Therefore a scheduled daily adjustment of venetian blinds can prevent plant injury. Unfortunately, the plant owner will not always be available to adjust the venetian blind on a daily schedule.

Venetian blinds regulate incoming light by adjusting the angle of elevation of a plurality of parallel slats or louvers. The original designs adjusted the slat angle with pull cords, although more recent designs replaced the pull cords with a vertical adjustment rod. This adjustment rod can be spun on its axis to operate a mechanism atop the venetian blind that adjusts the angle of elevation of the slats or louvers in the blind.

U.S. Pat. Nos. 4,173,721; 4,610,294; and 4,958,112 have mechanisms that pull the adjusting cords of draperies or venetian blinds. These mechanisms are designed to work with cords and therefore would be unusable with a venetian blind employing an adjustment rod. These references employ timers to operate the cords according to a predetermined schedule. See also U.S. Pat. Nos. 1,187,381; 1,525,781; and 4,664,169.

Accordingly, there is a need for a mechanism to adjust the adjustment rod on venetian blinds.

SUMMARY OF THE INVENTION

In accordance with the illustrative embodiments demonstrating features and advantages of the present invention there is provided a drive mechanism for spinning a vertical adjustment rod of a venetian blind mounted at a window. The mechanism has a case adapted to be mounted at the window. Also included is a drive means mounted in the case and adapted to be coupled to the adjustment rod. This drive means can operate to turn the adjustment rod. The drive mechanism also has a control means coupled to the drive means for controlling the turning of the adjustment rod.

By employing apparatus of the foregoing type, an improved drive mechanism is achieved for adjusting venetian blinds. In a preferred embodiment, a solenoid can vertically reciprocate a hollow armature. The armature has on opposite ends, a pawl/ratchet mechanism to convert the vertical reciprocation of the armature into rotary motion. Driving the armature up causes rotation in one direction, while rotation in the opposite direction is caused by driving the armature down. By employing a hollow armature, the adjustment rod can pass through the center of the drive mechanism. This allows one to conveniently adjust the drive mechanism vertically along the length of the adjustment rod.

In the preferred embodiment, a control circuit can pulse a switch to provide a current that drives the armature repetitively up (or down). By regulating the switching pulses, the rate and extent of rotation of the adjustment rod is controlled. The preferred embodiment has a timer that operates the solenoid according to a predetermined schedule, which is set by the operator.

An accessory is also provided for linking the drive mechanism to an adjustment rod that is spaced from the case of the drive mechanism. In one embodiment the drive mechanism rotates a spindle linked by a belt or other means to a driven capstan, which connects to the adjustment rod. This feature gives the drive mechanism the flexibility of being mounted at various positions relative to the adjustment rod. This feature is important where the clearance around the adjustment rod is limited.

BRIEF DESCRIPTION OF THE DRAWINGS

The above brief description as well as other objects, features and advantages of the present invention will be more fully appreciated by reference to the following detailed description of presently preferred, but nonetheless illustrative embodiments in accordance with the present invention, when taken in conjunction with the accompanying drawings, wherein:

FIG. 1 is an elevational view, partially in section, of a drive mechanism in accordance with the principles of the present invention;

FIG. 2 is a detailed, axonometric view of one of the pawls illustrated in FIG. 1;

FIG. 3 is a detailed, axonometric view of the support bracket partially illustrated in FIG. 1;

FIG. 5 is an elevational view of a control panel on the case of the drive mechanism of FIG. 1;

DETAILED DESCRIPTION OF THE PREFERRED EMBODIMENTS

Figure 7:
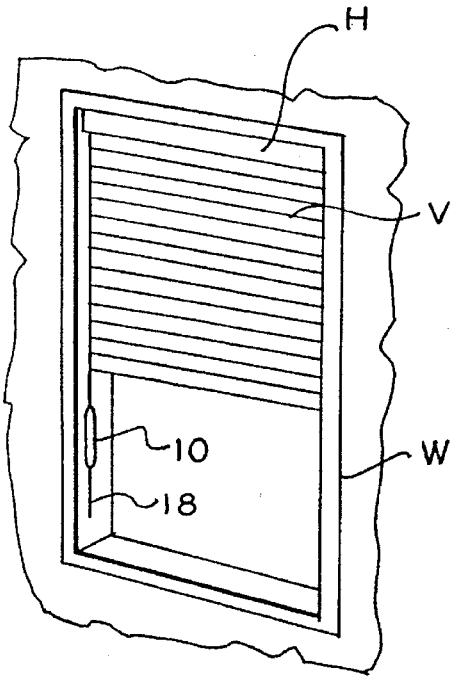
FIG. 7 is an axonometric of the drive mechanism of FIG. 1 mounted at a window and coupled to an adjustment rod of a venetian blind.

Referring to FIGS. 1, 2 and 3, a drive mechanism is shown as a cylindrical case 10 having rounded corners. An upper hollow spindle 12 and a lower hollow spindle 14 are mounted in concentric openings on the upper and lower end of case 10. Spindle 12 has a holding means, shown as a set screw 16 designed to secure spindle 12 to adjustment rod 18. As described further hereinafter, rod 18 is used to adjust the angle of elevation of slats or louvers in a venetian blind. Hollow spindle 14 has a similar holding means shown as a set screw 20.

Upper spindle 12 has a lower flange that is ringed with a plurality of ratchet teeth 22. Teeth 22 have a sawtooth profile and are arranged in a circle to project down from the underside of spindle 12. Also, lower hollow spindle 14 has projecting upwardly from its upper flange a number of ratchet teeth 24, again with a sawtooth profile and laid in a circle.

A drive means is shown herein with a tubular, magnetized armature 26. Armature 26 is coaxially mounted within the electrical windings of solenoid coil 28, herein referred to as an electromagnetic means. Armature 26 is normally and neutrally supported by a helical compression spring 30, referred to as a yielding means. Batteries B are shown mounted in a lower portion of case 10.

Pawls 32 and 34 are mounted on the upper and lower ends of armature 26. In a preferred embodiment, there are four pawls, two on each end of the armature 26. The pawls 32 and 34 are pivotally mounted at the outside corners of armature 26. FIG. 2 shows pawl 32 pivotally mounted by pin 36 to the armature 26. Pawl 32 is mounted in a generally rectangular recess 38 having a slot 40 in one of its lower corners. Mounted in slot 40 is the vertical tab 42A of leaf spring 42. The midsection 42B of leaf spring 42 underlies pawl 32 and merges with a vertical arm 42C of leaf spring 42. Configured in this fashion, leaf spring 42 urges pawl 32 to rotate counterclockwise (as shown in FIG. 2).

The combination of ratchet teeth 22 and pawl 32 is herein referred to as an upper means, while ratchet teeth 24 and pawl 34 are referred to as a lower means (the upper and lower means together are referred to as a converter means).

A rectangular plate 44 projects radially from the periphery of case 10, and may be an integrally molded flange (although in some embodiments a separately fastened attachment may be used instead). Threaded into the outer end of plate 44 is a set screw 46. Set screw 46 holds a T-shaped bracket 48 to plate 44. Fixture 48 has a slotted longitudinal branch 48A and a trapezoidal transverse branch 48B. The slot in branch 48A allows the fixture 48A to straddle set screw 46 while being extended or retracted.

In FIG. 3, the transverse branch 48B is shown adapted to fit in a holding bracket 50. Bracket 50 has a C-shaped plan. The bevelled side of transverse branch 48B matches the slant on the inside walls of bracket 50 to hold the two together. Bracket 50 can be secured to a window frame or adjacent wall by attachment screws 52.

Figure 4:
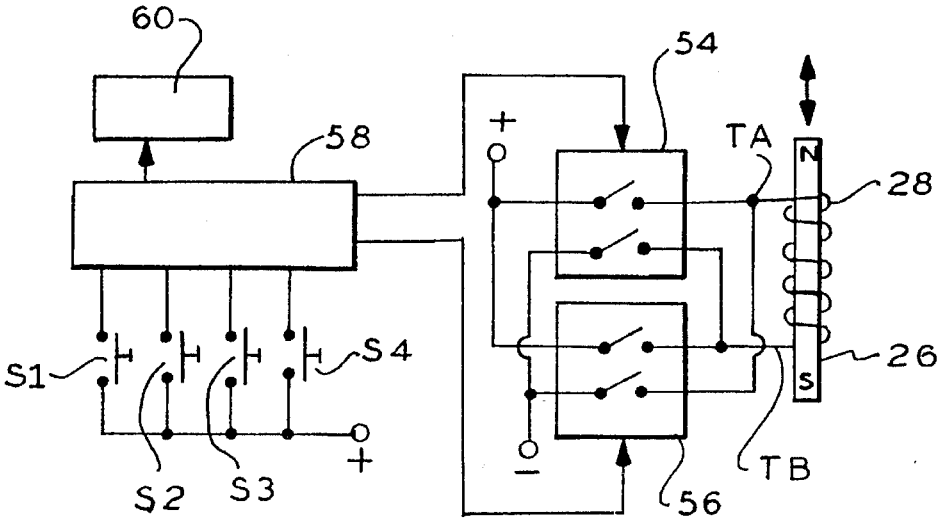
FIG. 4 is a block schematic diagram of a control means mounted in the case of the drive mechanism of FIG. 1.

Referring to FIG. 4, a control means is shown herein driving previously mentioned solenoid windings 28 through its terminals TA and TB to vertically reciprocate armature 26. Solenoid 28 is shown connected to switching means 54 and 56. Switching means 54 is an electronically controlled, dual pole, single throw switch having one switch connected from terminal TA to positive potential and the other switch connected from terminal TB to negative potential. Similarly, switching means 56 is an electronically controlled, dual pole, single throw switch having one switch connected from terminal TB to positive potential and the other switch connected from terminal TA to negative potential.

By alternately energizing switching means 54 and 56, bidirectional current can be applied to solenoid winding 28. Since it is magnetized, armature 26 can be actively driven either up or down, depending upon the polarity of current through winding 28.

The control inputs of switching means 54 and 56 are shown separately connected to a digital control circuit 58, which in one embodiment is a microprocessor, although various discrete timing circuits can be used instead. Four mode switches S1–S4 are each connected to a common positive potential to separate inputs on controller 58. Controller 58 drives a display 60, as described presently.

Referring to FIG. 5, display 60 is shown mounted in casing 10 over mode switches S1–S4. Display 60 has a liquid crystal display to display: time, each of the seven days of the week and an AM/PM indication. The mode switches S1–S4 are labeled as follows: mode, plus, minus, set.

Mode switch S1 can cycle the system through several different modes. In one mode the internal clock can be set to the correct day and time of day as indicated on the display 60. In another mode, one of several adjustment cycles can be chosen. Once the particular cycle is selected, the start time and the duration of the cycle can be using the other switches and display 60.

For example, a first cycle can be chosen with a start time of noon, at which time the blind is adjusted by turning the adjustment rod to one extreme position and then reversing its direction for a predetermined number of pulses as described hereinafter. The number of pulses is chosen to adjust the slats of the venetian blind to a predetermined percentage of opening (e.g., closed, quarter open, half open, three quarter open, or fully opened). Alternatively, various timers (mechanical or electrical) used in the prior art for timing the opening and closing a blind can be used instead.

Figure 6:
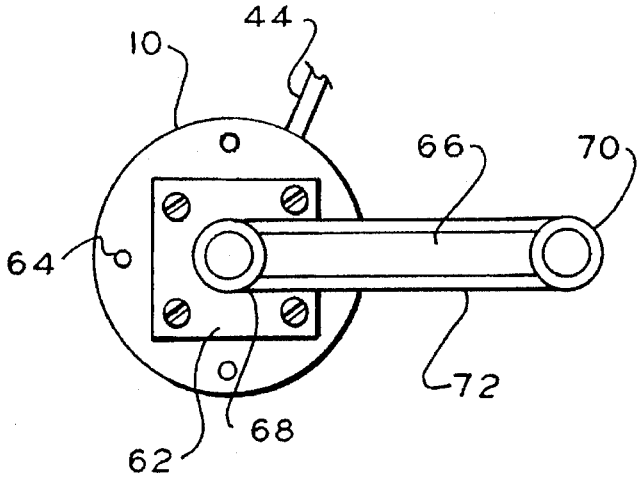
FIG. 6 is a link used as an accessory with the drive mechanism of FIG. 1.

Referring to FIG. 6, a link is shown with an attachment plate 62 screwed to four of eight selectable screw holes 64, arranged in a circle atop case 10. Arranged in this fashion, plate 62 can be adjusted in 45° increments (although other angular increments can be chosen instead). This enables one to set the extension arm 66 mounted atop plate 62 at various angles with respect to mounting plate 44.

Rotatably mounted in the center of plate 62 is a spindle 68. Spindle 68 can be designed to be attached to the previously mentioned hollow spindle (spindle 12 of FIG. 1). Thus the turning of the spindle in casing 10 can drive spindle 68 as well. The periphery of spindle 68 is grooved to operate as a pulley.

An arm 66 is mounted atop plate 62. Mounted on the distal end of arm 66 is a capstan 70. Capstan 70 is driven by a belt 72 that circulates around capstan 70 and spindle 68. The center of capstan 70 is hollow so that the previously mentioned adjustment rod can be mounted within capstan 70. Accordingly, the drive mechanism in case 10 can spin spindle 68 to rotate capstan 70 and turn the previously mentioned adjustment rod. Significantly however, the adjustment rod may be parallel to but spaced from the axis of case 10.

To facilitate an understanding of the principles associated with the foregoing apparatus, its operation will be briefly described. Case 10 may be mounted as shown in FIG. 7 around the vertical adjustment rod 18. As shown in FIG. 1, case 10 and its associated spindles 12 and 14, as well as its armature 26 provide a passage so that adjustment rod 18 can pass completely through case 10 as shown in FIG. 7.

Adjustment rod 18 extends up to a housing H from which the slats or louvers V of a venetian blind are suspended. In a known fashion, turning adjustment rod 18 changes the angle of elevation of the slats V of the venetian blind.

Case 10 can be mounted to the frame of window W by screwing bracket 50 (FIG. 3) to the frame. Thereafter, fixture 48 can be inserted into bracket 50 to support case 10. The radial spacing of case 10 can be adjusted by loosening set screw 46 and changing the amount of extension of bracket 48. Alternatively, the accessory shown in FIG. 6 can be employed so that the case 10 can be positioned at a distance from the adjustment rod. Because the adjustment rod can slip through case 10 (or through the capstan 70 of the accessory of FIG. 6) the vertical adjustment of the case is not critical. Furthermore, the case can be quickly removed from its bracket 50 (FIG. 3) and used at a different location.

The control means of FIG. 4 and 5 can be programmed to provide a scheduled adjustment of the venetian blinds, in the manner described previously. When the blinds are to be adjusted, pulses are applied to either switch 54 or 56 (FIG. 4) to push armature 26 up or down periodically.

Referring to FIGS. 1 and 2, upward reciprocation of armature 26 causes pawl 32 to engage the ratchet teeth 22. On an upward thrust, pawl 32 hits the inclined surface of ratchet teeth 22 to rotate the spindle 12 and adjustment rod 18 clockwise (when viewed from above). In that upward thrust, pawl 32 will rotate clockwise (as viewed in FIG. 2) to give the spindle 12 an additional push. When pawl 32 retracts, and clears the ratchet teeth 22, leaf spring 42 will rotate pawl 32 counterclockwise, back to the position shown in FIG. 2. Continued upward thrusts of armature 26 will cause an incremental, step-wise revolution of the adjustment rod 18.

Reverse rotation can be accomplished by energizing switch 56 (FIG. 4) to thrust the solenoid armature 26 down. The pawl 34 (FIG. 1) then engages ratchet teeth 24 to rotate the hollow spindle 14 incrementally in a counterclockwise direction (when viewed from above). As before, pawl 34 will rotate to give the ratchet teeth 24 an additional push and then retract to its original vertical position.

It is to be appreciated that various modifications may be implemented with respect to the above described preferred embodiments. While an axially reciprocating solenoid is illustrated, in some embodiments a conventional motor or a stepper motor may be used. These more conventional motors may or may not employ a hollow drive shaft to allow the adjustment rod to fit concentrically within a drive mechanism. Also while battery power is illustrated, in some embodiments house current may be used instead. Moreover, various types of mounting structures are possible and in some embodiments the case may be fastened directly to a window frame or wall. Also where a pawl and ratchet mechanism is used, the position of the pawl and ratchet can be reversed. Moreover, the mounting of the pawl can be varied and the spring bias can be by various mechanisms or by gravity. Furthermore while a microprocessor timer is illustrated, in some embodiments a mechanical timer using cam actuated switches may be employed instead. Also the various illustrated structural components can be made of plastic, metal, ceramics or other materials, depending upon the desired strength, weight, etc. In addition, the shape of the case and the shape and dimensions of the various illustrated components can be altered depending upon the expected size of the adjustment rod, the desired torque, rotation speed, etc.

Obviously, many modifications and variations of the present invention in light of the above teachings. It is therefore to be understood that within the scope of the appended claims, the invention may be practiced otherwise than as specifically described.

I claim:

1. A drive mechanism for spinning a vertical adjustment rod of a venetian blind mounted at a window, comprising:

a case adapted to be mounted at said window;

a drive means mounted in said case and adapted to be coupled to said adjustment rod, said drive means having a spindle with a cavity sized to engage and turn said adjustment rod; and control means coupled to said drive means for controlling the turning of said adjustment rod.

2. A drive mechanism according to claim 1 wherein said control means is operable to start the turning of said adjustment rod according to an operator selected schedule.

3. A drive mechanism according to claim 2 wherein said control means is operable to stop the turning of said adjustment rod after a predetermined number of revolutions.

4. A drive mechanism according to claim 3 wherein said control means is operable to turn said adjustment rod at a predetermined rate.

5. A drive mechanism according to claim 1 wherein said spindle is hollow and sized to encompass said adjustment rod.

6. A drive mechanism according to claim 5 wherein said hollow spindle is tubular and arranged to allow adjustable positioning of said case lengthwise along said adjustment rod.

7. A drive mechanism according to claim 6 wherein said case and spindle have a passage to allow said adjustment rod to pass completely through said case.

8. A drive mechanism according to claim 7 comprising:

a holding means mounted in said spindle to prevent relative axial movement between said spindle and said adjustment rod.

9. A drive mechanism according to claim 1 wherein said drive means is operable to angularly advance said adjustment rod in incremental steps.

10. A drive mechanism according to claim 9 wherein said drive means comprises:

an armature mounted in said case for axially reciprocating therein; and converter means coupled to said armature for converting its axial reciprocation into rotary motion.

11. A drive mechanism according to claim 10 comprising:

electromagnetic means for actively propelling said armature in either one of two opposite directions, said converter means being operable in response to propulsion of said armature in one of said opposite directions to turn said adjustment rod with one of two opposite rotations.

12. A drive mechanism according to claim 11 wherein said control means comprises:

switching means for applying current pulses to said electromagnetic means having either one of two polarities.

13. A drive mechanism according to claim 10 wherein said drive means is operable to actively propel said armature in either one of two opposite directions, said converter means comprising:

an upper means and lower means mounted in said case above and below said armature, respectively, said armature being driveable upwardly and downwardly to engage said upper means and said lower means, respectively.

14. A drive mechanism according to claim 13 wherein said upper means and said lower means each comprise:

a pawl and ratchet mechanism.

15. A drive mechanism according to claim 14 wherein the pawls of said upper means and said lower means are mounted on opposite ends of said armature.

16. A drive mechanism according to claim 15 wherein the ratchets of said upper means and said lower means each comprise:

a toothed ring sized to encompass and be secured to said adjustment rod.

17. A drive mechanism according to claim 16 wherein said toothed ring is annular and arranged to allow adjustable positioning of said case lengthwise along said adjustment rod.

18. A drive mechanism according to claim 17 wherein said armature is tubular.

19. A drive mechanism according to claim 18 comprising:

yielding means for urging said armature into a neutral position between said upper and lower means.

20. A drive mechanism according to claim 10 wherein said armature is tubular.

21. A drive mechanism according to claim 1 wherein said case has a central vertical axis, said drive mechanism comprising:

a link having a spindle driven by said drive means and a capstan adapted to drive said adjustment rod, said capstan being driven by said spindle to rotate about an axis spaced from and parallel to said central vertical axis.

22. A drive mechanism for spinning a vertical adjustment rod of a venetian blind mounted at a window, comprising:

a case having a central vertical axis, and adapted to be mounted at said window;

a drive means mounted in said case and adapted to be coupled to said adjustment rod, said drive means being operable to turn said adjustment rod; and control means coupled to said drive means for controlling the turning of said adjustment rod, said drive means including:

a link having a spindle driven by said drive means and a capstan adapted to drive said adjustment rod, said capstan being driven by said spindle to rotate about an axis spaced from and parallel to said central vertical axis.

* * * * *